US012498200B2

(12) United States Patent
Hyun et al.

(10) Patent No.: US 12,498,200 B2
(45) Date of Patent: Dec. 16, 2025

(54) APPARATUS AND METHOD FOR DISPLAYING SHOOTING AREA OF GUIDED MISSILE IN REAL TIME

(71) Applicant: AGENCY FOR DEFENSE DEVELOPMENT, Daejeon (KR)

(72) Inventors: Dai Kyung Hyun, Daejeon (KR); Hyo Seok Yun, Daejeon (KR); Ye Jun Kang, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 273 days.

(21) Appl. No.: 18/482,708

(22) Filed: Oct. 6, 2023

(65) Prior Publication Data

US 2025/0334376 A1 Oct. 30, 2025

(30) Foreign Application Priority Data

Nov. 29, 2022 (KR) ..... 10-2022-0162135

(51) Int. Cl.
*F41G 7/22* (2006.01)
*F41G 3/16* (2006.01)
*F41G 3/22* (2006.01)

(52) U.S. Cl.
CPC ..... *F41G 7/2253* (2013.01); *F41G 3/165* (2013.01); *F41G 3/22* (2013.01)

(58) Field of Classification Search
USPC ..... 348/169
See application file for complete search history.

(56) References Cited

U.S. PATENT DOCUMENTS

| | | | | |
|---|---|---|---|---|
| 10,376,777 | B2 * | 8/2019 | Shiina | A63F 13/213 |
| 10,474,764 | B1 * | 11/2019 | Bolton | G06F 30/00 |
| 2019/0154402 | A1 * | 5/2019 | Rowlands | F41G 7/007 |
| 2019/0240637 | A1 * | 8/2019 | Park | A01M 25/006 |

* cited by examiner

*Primary Examiner* — Nigar Chowdhury
(74) *Attorney, Agent, or Firm* — Knobbe Martens Olson & Bear LLP

(57) ABSTRACT

An apparatus for displaying a shooting area of a guided missile is proposed. The apparatus may include a display, a memory, and a processor. The processor may display the shooting area of the guided missile and an indicator indicating whether the guided missile can hit a target on the display based on a size of the shooting area. The processor may display the indicator having an X-axis position calculated based on a yaw angle between a longitudinal axis line and the target and a horizontal distance from the center of the display to the shooting area, and a Y-axis position calculated based on a pitch direction angle between the longitudinal axis line and the target and a vertical distance from the center of the display to the shooting area. The indicator may indicate that the guided missile can hit the target when the indicator is displayed within the shooting area.

12 Claims, 7 Drawing Sheets

APPARATUS AND METHOD FOR DISPLAYING SHOOTING AREA OF GUIDED MISSILE IN REAL TIME

CROSS-REFERENCE TO RELATED APPLICATION

This application claims priority to Korean Patent Application No. 10-2022-0162135 filed on Nov. 29, 2022, the entire contents of which are incorporated herein by reference.

BACKGROUND

Technical Field

The present disclosure relates to an apparatus and method for displaying a shooting area of a guided missile, and more particularly, to an apparatus and method for displaying whether or not a guided missile can hit a target to an operator of an aircraft in real time when the guided missile is launched from the aircraft.

Description of Related Technology

In order for an air-to-ground guided missile launched from an aircraft to hit a target, the operator of the aircraft must maneuver the longitudinal axis within a predetermined range based on the target.

SUMMARY

An object of the present disclosure is to provide an apparatus and method for displaying a shooting area of a guided missile to an aircraft operator in real time.

Another object of the present disclosure is to provide an apparatus and method for displaying whether a guided missile launched from an aircraft can hit a target to an operator of the aircraft in real time.

In accordance with a first aspect, there is provided an apparatus for displaying a shooting area of a guided missile, comprising: a display; a memory; and a processor configured to display the shooting area of the guided missile on the display and to display an indicator indicating whether the guided missile is able to hit a target on the display based on a size of the shooting area, wherein the processor is configured to display on the display the indicator which has an X-axis position calculated based on a yaw angle between a longitudinal axis line and the target and a horizontal distance from the center of the display to the shooting area, and a Y-axis position calculated based on a pitch direction angle between the longitudinal axis line and the target and a vertical distance from the center of the display to the shooting area, and wherein the indicator indicates that the guided missile is able to hit the target when the indicator is displayed within the shooting area.

In accordance with a second aspect, there is provided a method of displaying a shooting area of a guided missile to be performed by an apparatus for displaying a shooting area of a guided missile, the method comprising: displaying the shooting area of the guided missile on a display; displaying on the display an indicator indicating whether the guided missile is able to hit a target on the display based on a size of the shooting area; and adjusting a position of the indicator on the display, wherein the displaying the indicator comprises: calculating an X-axis position of the indicator based on a yaw angle between a longitudinal axis line and the target and a horizontal distance from the center of the display to the shooting area; and calculating a Y-axis position of the indicator based on a pitch direction angle between the longitudinal axis line and the target and a vertical distance from the center of the display to the shooting area, wherein the indicator indicates that the guided missile is able to hit the target when the indicator is displayed within the shooting area.

In accordance with a third aspect, there is provided a non-transitory computer-readable storage medium in which a computer program is stored, the computer program including instructions for causing, when executed by a processor, the processor to perform a method of displaying whether or not shooting is possible, the method comprising: displaying a shooting area of a guided missile on a display; displaying on the display an indicator indicating whether the guided missile is able to hit a target on the display based on a size of the shooting area such that the indicator has an X-axis position calculated based on a yaw angle between a longitudinal axis line and the target and a horizontal distance from the center of the display to the shooting area, and a Y-axis position calculated based on a pitch direction angle between the longitudinal axis line and the target and a vertical distance from the center of the display to the shooting area; and adjusting a position of the indicator on the display, wherein the indicator indicates that the guided missile is able to hit the target when the indicator is displayed within the shooting area.

According to one embodiment of the present disclosure, it is possible to display an area in which a guided missile can be shot to an aircraft operator in real time.

According to one embodiment of the present disclosure, it is possible to provide information on whether a guided missile launched from an aircraft can hit a target to an operator of the aircraft in real time.

The problem to be solved by the present disclosure is not limited to those described above, and another problem to be solved that is not described may be clearly understood by those skilled in the art to which the present disclosure belongs from the following description.

DETAILED DESCRIPTION

Figure 1:
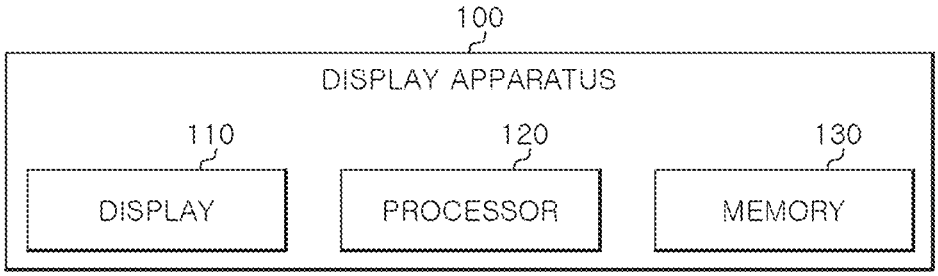
FIG. 1 is a diagram showing a shooting area display apparatus according to an embodiment of the present disclosure.

In the case of a helicopter, if a target moves while the helicopter is maneuvering, it is difficult to shoot the target and may affect the accuracy rate. Therefore, the operator of the helicopter needs to recognize the area or range in which a guided missile can hit a target, and for this, an area in which the guided missile can be shot needs to be displayed in real time on a screen that the operator of the helicopter looks at to shoot the target.

The above and other objectives, features, and advantages of the present disclosure will be easily understood from the following preferred embodiments in conjunction with the accompanying drawings. However, the present disclosure may be embodied in different forms without being limited to the embodiments set forth herein. Rather, the embodiments disclosed herein are provided to make the disclosure thorough and complete and to sufficiently convey the spirit of the present disclosure to those skilled in the art. The scope of the present disclosure is merely defined by the claims.

In the following description of the present disclosure, detailed descriptions of known functions and configurations which are deemed to make the gist of the present disclosure obscure will be omitted. Since the terms can be differently defined according to the intention of a user or an operator or customs, these terms should be interpreted as having a meaning that is consistent with the technical spirit of the present disclosure.

The functional blocks shown in the drawings and described below are only possible implementations. Other functional blocks may be used in other implementations without departing from the spirit and scope of the detailed description. In addition, while one or more functional blocks of the present disclosure are represented as individual blocks, one or more of the functional blocks of the present disclosure may be a combination of various hardware and software configurations that perform the same function.

Further, the expression "certain components are included" simply indicates that corresponding components are present, as an open expression, and should not be understood as excluding additional components.

Furthermore, it should be understood that when an element is referred to as being "coupled" or "connected" to another element, it can be directly coupled or connected to the other element or intervening elements may be present therebetween.

Further, it will be understood that the terms "first", "second", etc. are used herein to distinguish one element from another element, these terms do not limit the order or other features between the elements.

Hereinafter, the embodiments of the present disclosure will be described with reference to the accompanying drawings.

FIG. 1 is a diagram showing a shooting area display apparatus according to an embodiment of the present disclosure.

Referring to FIG. 1, an apparatus 100 for displaying a shooting area of a guided missile according to an embodiment of the present disclosure includes at least one display 110, at least one processor 120, and at least one memory 130.

The display 110 provides a screen for assisting in shooting at a target to an operator or pilot of an aircraft. To this end, the display 110 may be provided in a cockpit of the aircraft, and may be implemented as, for example, a head-up display (HUD).

The processor 120 may control a screen or an image displayed on the display 110. Specifically, the processor 120 may display, on the display 110, an area where a guided missile can hit a target (hereinafter, referred to as a shooting area) when the guided missile is launched from the aircraft. The shooting area may be displayed on the display 110 in any size or shape. For example, in a case in which the display 110 is provided in a helicopter, the shooting area on the display 110 may be set in any size or shape by an operator or pilot of the helicopter.

Further, the processor 120 may display an indicator indicating whether the guided missile can hit a target on the display 110 in real time. Here, the indicator may be displayed on the display 110 based on the size of the shooting area displayed on the display 110. If the indicator is located within the shooting area on the display 110, it can indicate that the guided missile can hit the target. However, if the indicator is located outside the shooting area on the display 110, it can indicate that the guided missile cannot hit the target.

To this end, the processor 120 may calculate an angle with respect to a target based on the longitudinal axis line of the aircraft and indicate the indicator on the display 110 based on the angle with respect to the target, the size of the shooting area, and a range in which the guided missile can hit the target. For example, the processor 120 may calculate an X-axis position of the indicator on the display 110 based on a yaw direction angle between the longitudinal axis line and the target and a horizontal distance (or width) from the center of the display 110 to the shooting area and calculate a Y-axis position of the indicator on the display 110 based on a pitch direction angle between the longitudinal axis line and the target and a vertical distance (or height) from the center of the display 110 to the shooting area. The coordinates of the indicator on the display 110 may be determined by the X-axis position and the Y-axis position.

The processor 120 may calculate the coordinates of the indicator in real time and adjust or change the position of the indicator on the display 110 in real time based on the calculated coordinates.

The memory 130 may store a program executed by the processor 120, information on shooting areas, coordinate information on an indicator indicating whether a guided missile can hit a target on the display, and the like. The program may include instructions for causing the processor 120 to display, on the display 110, a shooting area of a guided missile and an indicator indicating whether the guided missile can hit a target.

Figure 2:
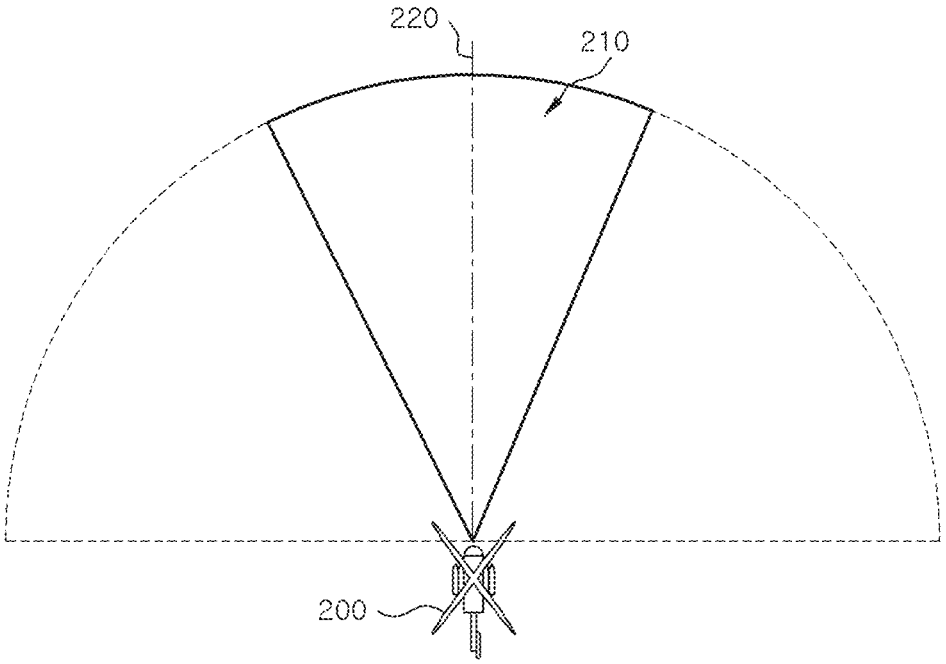
FIG. 2 is a diagram schematically showing an area in which a guided missile can be shot.
Figure 3:
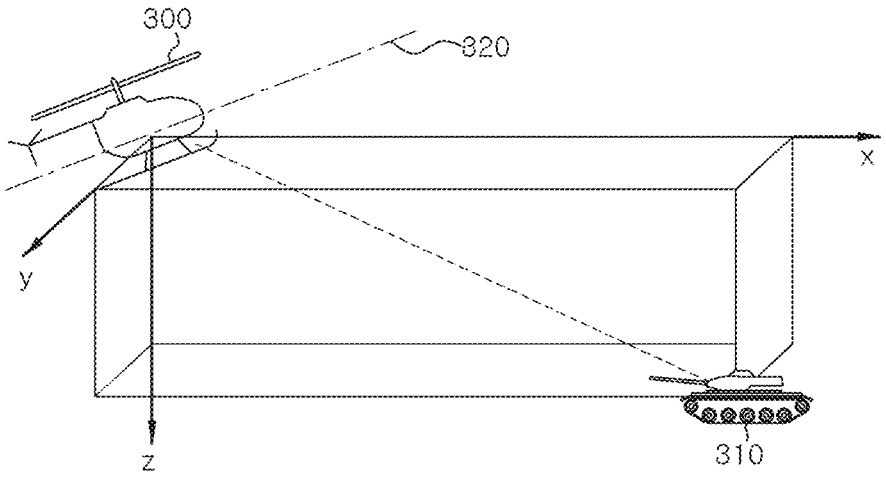
FIG. 3 is a diagram illustrating a relationship between a longitudinal axis line and a target.

FIG. 2 is a diagram schematically showing an area where a guided missile can be shot, and FIG. 3 is a diagram showing a relationship between a longitudinal axis and a target.

Hereinafter, as an example, a case of launching an air-to-ground guided missile from a helicopter will be described.

First, referring to FIG. 2, the guided missile has a predetermined shooting area 210 in a certain range based on the helicopter 200. Although the shooting area 210 may vary depending on the location of the helicopter 200, the attitude of the helicopter 200, a maneuvering state of the helicopter 200, a distance from a target, a launch trajectory of the guided missile, the performance of the guided missile, external conditions, and the like, the shooting area 210 is located in a certain area based on the longitudinal axis line 220 of the helicopter 200.

The three-dimensional relationship between the helicopter and a target is represented as shown in FIG. 3, and in order for the helicopter 300 to launch the guided missile and hit the target 310, the longitudinal axis line 320 of the helicopter 300 needs to be aligned within the shooting area.

To this end, the shooting area display apparatus according to an embodiment of the present disclosure may display the shooting area of the guided missile and the indicator indicating whether the guided missile can hit the target on a display in the helicopter in real time through the following method.

Figure 4:
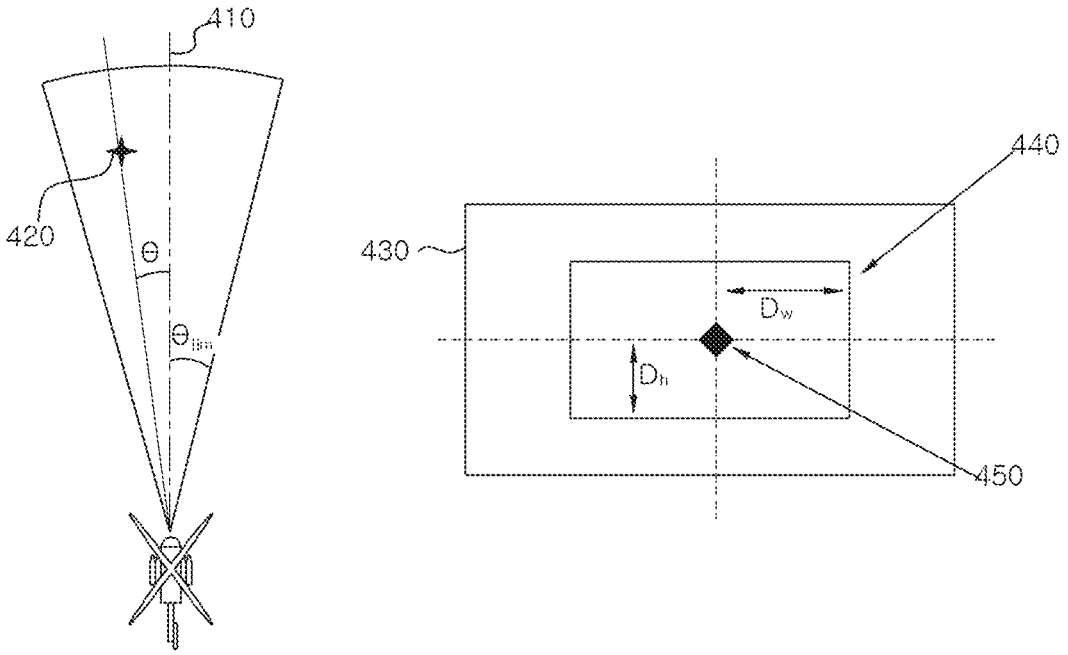
FIG. 4 is a diagram illustrating a method of displaying an area in which a guided missile can be shot and an indicator indicating whether the guided missile can hit a target on a display according to an embodiment of the present disclosure.

FIG. 4 is a diagram illustrating a method of displaying a shooting area of a guided missile and an indicator indicating whether the guided missile can hit a target on a display according to an embodiment of the present disclosure.

As shown in FIG. 4, when the angle between the target 420 and the longitudinal axis line axis 410 of the helicopter is θ, and the range of the shooting area based on the longitudinal axis line 410 of the helicopter is $\theta_{lim}$, if $\theta<\theta_{lim}$ is satisfied, the guided missile can hit the target 420.

In a case in which the shooting area 440 of the guided missile is displayed as a rectangle and the indicator 450 indicating whether the guided missile can hit the target 420 is displayed as a rhombus on the display 430, the position (or coordinates) of the rhombus 450 on the display 430 may be calculated by Mathematical Expression 1 below.

[Mathematical Expression 1]

$$X \text{ position of rhombus} = \frac{\theta_y \times D_w}{\theta_{lim(y)}}$$

$$Y \text{ position of rhombus} = \frac{\theta_p \times D_h}{\theta_{lim(p)}}$$

Here, $D_w$ represents the horizontal distance (or width) of the shooting area 440 based on the center of the display 430, and $D_h$ represents the vertical distance (or height) of the shooting area 440 based on the center of the display 430. Further, $\theta_p$ represents a pitch direction angle between the target and the longitudinal axis line of the helicopter, and $\theta_y$ represents a yaw direction angle between the target and the longitudinal axis line of the helicopter. Further, $\theta_{lim(p)}$ represents a pitch direction range of the shooting area, and $\theta_{lim(y)}$ represent a yaw direction range of the shooting area.

The angle θ between the target 420 and the longitudinal axis line 410 of the helicopter may be defined as a longitudinal axis error, which may be derived through the following process.

The shooting area display apparatus according to the present disclosure includes navigation information indicating the current location of a helicopter and target information indicating the current location of a target. The processor of the shooting area display apparatus may use this information to calculate the longitudinal axis error of the helicopter. In order to calculate the longitudinal axis error, the processor may convert the location of the helicopter and the location of the target represented in latitude, longitude and altitude into an earth-centered earth-fixed frame (ECEF) using Mathematical Expression 2 below.

[Mathematical Expression 2]

$$R_{tr} = \frac{R_{eq}}{\sqrt{1-\epsilon^2\sin^2\lambda_{lat}}}$$

$$X_E = (R_{tr}+h)\cos\lambda_{lat}\cos\lambda_{lon}$$

$$Y_E = (R_{tr}+h)\cos\lambda_{lat}\sin\lambda_{lon}$$

$$Z_E = \left(R_{tr}\left(1-\epsilon^2\right)+h\right)\sin\lambda_{lat}$$

Here, $[\lambda_{lat}, \lambda_{lon}, h]$ denotes the [latitude, longitude, altitude] coordinate system, and $[X_E, Y_E, Z_E]$ denotes the ECEF. $R_{eq}$ represents the radius of the earth, and ε represents the eccentricity of the earth.

In addition, the relative position between the helicopter and the target on the ECEF may be calculated using Mathematical Expression 3 below.

$$X_{R_{ecef}} = X_{E_{target}} - X_{E_{missile}}$$

$$Y_{R_{ecef}} = Y_{E_{target}} - Y_{E_{missile}}$$

$$Z_{Recef} = Z_{E_{target}} - X_{E_{missile}}$$

[Mathematical Expression 3]

Here, $[X_{E_{target}}, Y_{E_{target}} - X_{E_{target}}]$ denotes the position of the target on the ECEF, and $[X_{E_{missile}}, Y_{E_{missile}}, Z_{E_{missile}}]$ denotes the position of the helicopter on the ECEF.

Thereafter, the processor may convert the ECEF into a helicopter body frame using Mathematical Expression 4 below in order to reflect the attitude of the helicopter.

[Mathematical Expression 4]

$$C_E^N = \begin{bmatrix} -\sin\lambda_{lat}\cos\lambda_{lon}, & -\sin\lambda_{lat}\sin\lambda_{lon}, & \cos\lambda_{lat} \\ -\sin\lambda_{lon}, & \cos\lambda_{lon}, & 0 \\ -\cos\lambda_{lat}\cos\lambda_{lon} & -\cos\lambda_{lat}\sin\lambda_{lon} & -\sin\lambda_{lat} \end{bmatrix}$$

$$C_N^B = \begin{bmatrix} \cos\theta\cos\psi, & \cos\theta\cos\psi, & -\sin\theta \\ -\cos\phi\sin\psi + \sin\phi\sin\theta\cos\psi, & \cos\phi\cos\psi + \sin\phi\sin\theta\sin\psi, & \sin\phi\cos\theta \\ \sin\phi\sin\psi + \cos\phi\sin\theta\cos\psi, & -\sin\phi\cos\psi + \cos\phi\sin\theta\sin\psi, & \cos\phi\cos\theta \end{bmatrix}$$

$$C_E^B = C_N^B \cdot C_E^N$$

Here, $[\lambda_{lat}, \lambda_{on}, h]$ denotes the position of the helicopter as [latitude, longitude, altitude], and [ϕ, θ, ψ] denotes the attitude of the helicopter as [roll, itch yaw].

$$C_E^N$$

denotes a direction cosine matrix from the ECEF to a navigation coordinate system, $$C_N^B$$

denotes a direction cosine matrix from the navigation coordinate system to a body frame, and $$C_E^B$$

denotes a direction cosine matrix from the ECEF to the body frame.

The processor of the shooting area display apparatus may calculate the position of the target using Mathematical Expression 5 in the helicopter body frame and calculate the longitudinal axis error using the position of the target.

[Mathematical Expression 5]

$$\begin{matrix} X_{R_{bodu}} \\ Y_{R_{bodu}} \\ Z_{R_{bodu}} \end{matrix} = C_E^B \cdot \begin{bmatrix} X_{R_{ecef}} \\ Y_{R_{ecef}} \\ Z_{R_{ecef}} \end{bmatrix}$$

-continued $$\theta_p = \arctan\left(\frac{-Z_{R_{bodu}}}{X_{R_{bodu}}}\right)$$

$$\theta_u = \arctan\left(\frac{Y_{R_{bodu}}}{\sqrt{X_{R_{bodu}}X_{R_{bodu}} + Z_{R_{bodu}}Z_{R_{bodu}}}}\right)$$

Here, $$C_E^B$$

denotes a direction cosine matrix from the ECEF to the body frame, $\theta_p$ denotes a pitch direction longitudinal axis error, and $\theta_u$ denotes a yaw direction longitudinal axis error.

Figure 5:
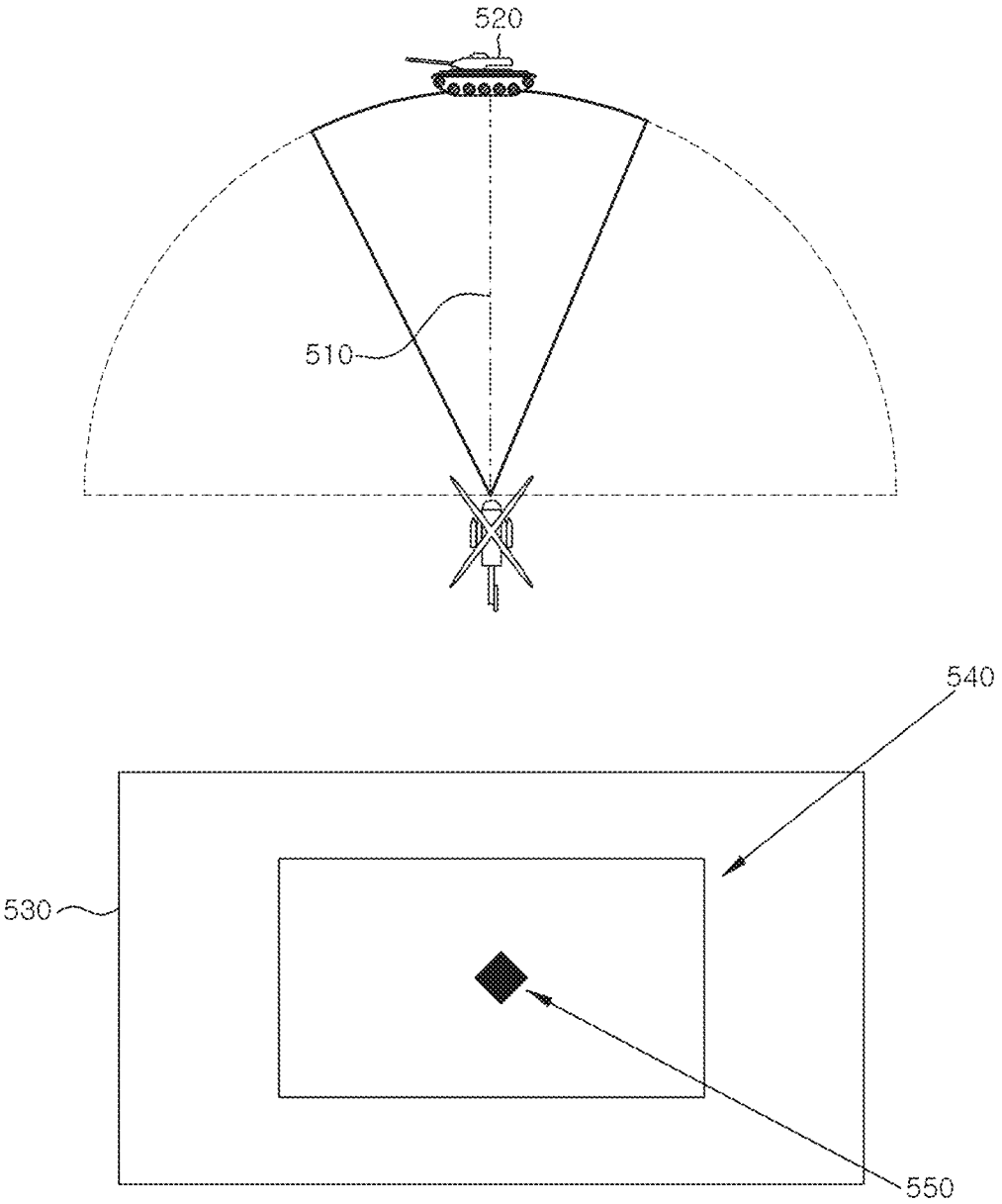
FIG. 5 is a diagram showing a case in which the shooting area display apparatus indicates that a guided missile can hit a target according to an embodiment of the present disclosure.
Figure 6:
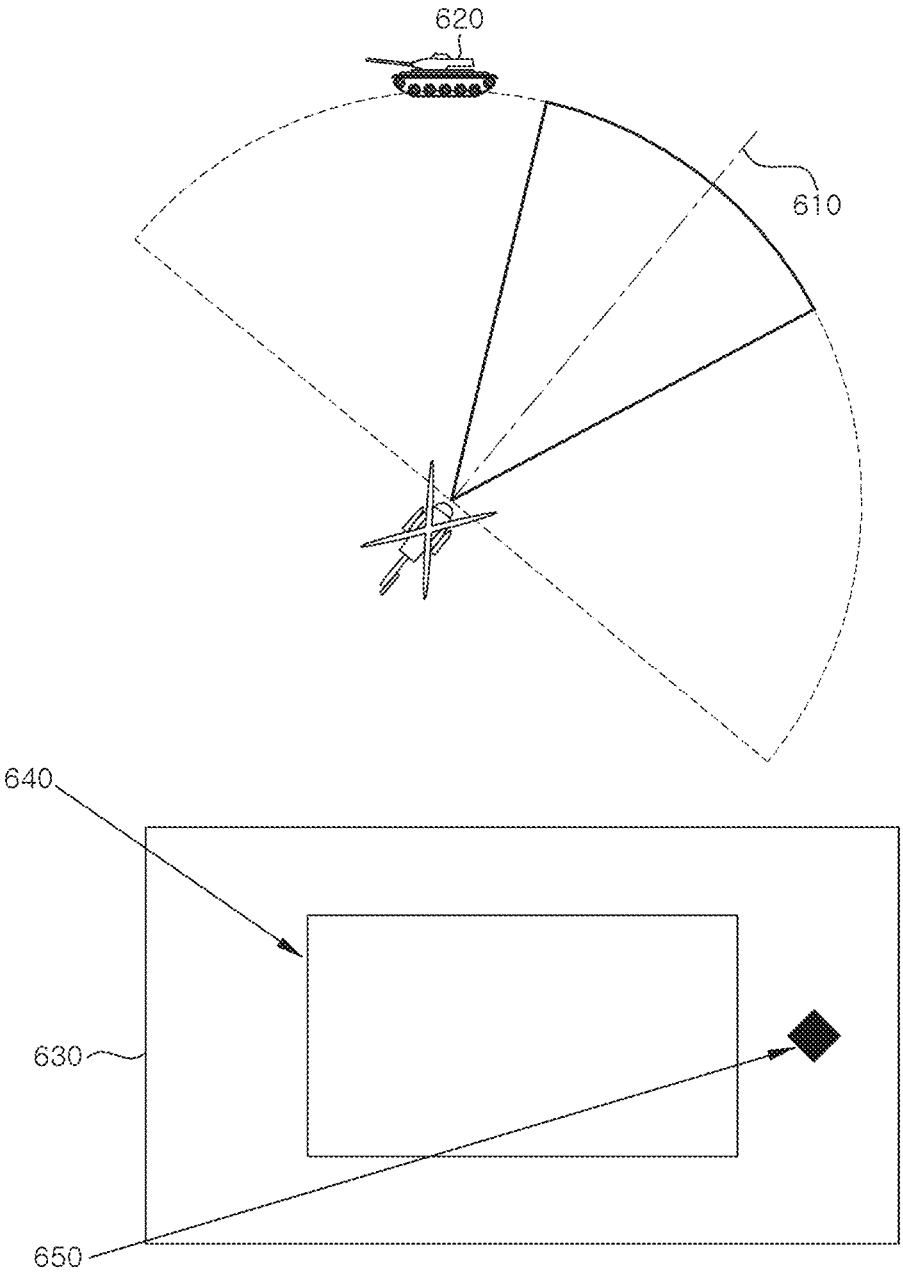
FIG. 6 is a diagram showing a case in which the shooting area display apparatus indicates that a guided missile cannot hit a target according to an embodiment of the present disclosure.

FIG. 5 is a diagram illustrating a case in which the shooting area display apparatus indicates that a guided missile can hit a target according to an embodiment of the present disclosure, and FIG. 6 is a diagram illustrating a case in which the shooting area display apparatus indicates that a guided missile cannot hit a target according to an embodiment of the present disclosure.

Referring first to FIG. 5, in a case in which a longitudinal axis error is 0, that is, in a case in which the angle between a longitudinal axis line 510 and a target 520 is 0, for example, the shooting area display apparatus may display an indicator 550 indicating whether a guided missile can hit the target 520 at the center of a shooting area 540 displayed on a display 530.

As another example, as shown in FIG. 6, in a case in which the longitudinal axis error deviates from the range of the shooting area, that is, in a case in which the angle θ between the longitudinal axis line 610 and the target 620 exceeds $\theta_{lim}$, the shooting area display apparatus may display the indicator 650 outside the shooting area 640 displayed on the display 630.

Therefore, the shooting area display apparatus according to an embodiment of the present disclosure can display the shooting area and the indicator indicating whether the guided missile can hit the target on the display based on the longitudinal axis error and the range of the shooting area. Accordingly, it is possible to display, to an aircraft operator, whether or not the guided missile can hit the target when firing the guided missile in real time with accuracy.

Although cases in which the shooting area is displayed in a rectangular shape on the display have been described as examples in FIGS. 5 and 6, the shooting area may be displayed in various shapes such as a circle and an ellipse in addition to a rectangle, and the size and position thereof may also be set to various sizes and positions. In addition, although examples of cases in which the indicator indicating whether a guided missile can hit a target is displayed as a rhombus on the display have been described in FIGS. 5 and 6, the shape of the indicator may also be displayed in various shapes such as a circle and a triangle.

As an example, in a case in which the position of the indicator indicating whether a guided missile can hit a target on the display moves within the shooting area as the target enters the shooting area, the shooting area display apparatus may change the size or color of the indicator in order to notify the operator that shooting is possible. For example, the shooting area display apparatus may display the indicator in blue in a first size in a case in which the target is located outside the range of the shooting area, and display the indicator displayed in red in a second size in a case in which the target enters the range of the shooting area. Here, the second size may be greater than the first size. In this case, the shooting area display apparatus may additionally use sound to inform the operator that shooting is possible.

Figure 7:
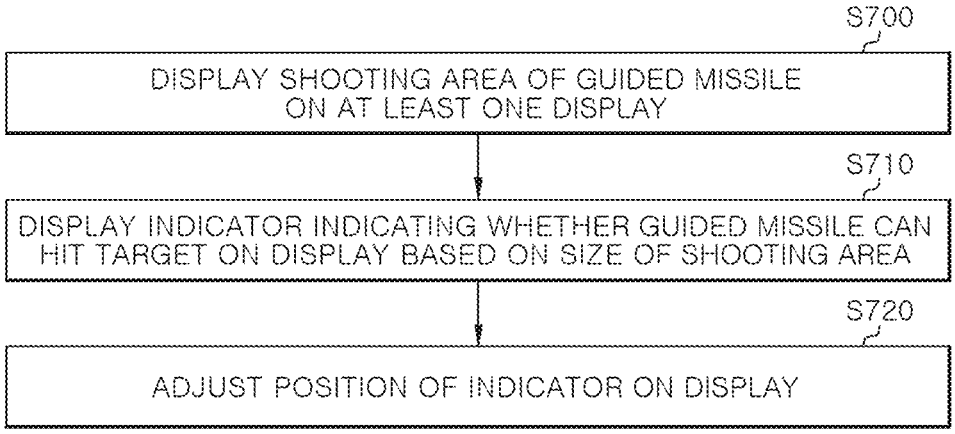
FIG. 7 is a diagram showing a method of displaying a shooting area according to an embodiment of the present disclosure.

FIG. 7 is a diagram illustrating a method of displaying a shooting area according to an embodiment of the present disclosure.

Referring to FIG. 7, the shooting area display apparatus according to an embodiment of the present disclosure may display a shooting area of a guided missile on at least one display (S700). Here, the display may be provided in a cockpit of an aircraft, and the shooting area may be displayed in any size or shape at any position on the display.

The shooting area display apparatus according to an embodiment of the present disclosure may display an indicator indicating whether the guided missile can hit a target on the display based on the size of the shooting area (S710). If the indicator is located within the shooting area on the display, it can indicate that the guided missile can hit the target, and if the indicator is located outside the shooting area on the display, it can indicate that the guided missile cannot hit the target.

To this end, the shooting area display apparatus may calculate the angle between the longitudinal axis line and the target based on Mathematical Expressions 1 to 5 and display the indicator (on the display) based on the angle with respect to the target, the size of the shooting area, and the range in which the guided missile can hit the target. Further, the shooting area display apparatus may adjust or change the position of the indicator on the display by calculating the coordinates of the indicator in real time (S720).

Meanwhile, the steps included in the method of displaying a shooting area performed by the shooting area display apparatus according to the above-described embodiment may be implemented as a computer program including instructions for causing the processor to perform these steps and recorded on a recording medium.

In addition, the steps included in the method of displaying a shooting area performed by the shooting area display apparatus according to the above-described embodiment may be implemented in a computer-readable recording medium in which a computer program including instructions for causing the processor to perform these steps is recorded.

Combinations of steps in each flowchart attached to the present disclosure may be executed by computer program instructions. Since the computer program instructions can be mounted on a processor of a general-purpose computer, a special purpose computer, or other programmable data processing equipment, the instructions executed by the processor of the computer or other programmable data processing equipment create a means for performing the functions described in each step of the flowchart. The computer program instructions can also be stored on a computer-usable or computer-readable storage medium which can be directed to a computer or other programmable data processing equipment to implement a function in a specific manner. Accordingly, the instructions stored on the computer-usable or computer-readable recording medium can also produce an article of manufacture containing an instruction means which performs the functions described in each step of the flowchart. The computer program instructions can also be mounted on a computer or other programmable data processing equipment. Accordingly, a series of operational steps are performed on a computer or other programmable data processing equipment to create a computer-executable process, and it is also possible for instructions to perform a computer or other programmable data processing equipment to provide steps for performing the functions described in each step of the flowchart.

In addition, each step may represent a module, a segment, or a portion of codes which contains one or more executable instructions for executing the specified logical function(s). It should also be noted that in some alternative embodiments, the functions mentioned in the steps may occur out of order. For example, two steps illustrated in succession may in fact be performed substantially simultaneously, or the steps may sometimes be performed in a reverse order depending on the corresponding function.

The above description is merely exemplary description of the technical scope of the present disclosure, and it will be understood by those skilled in the art that various changes and modifications can be made without departing from original characteristics of the present disclosure. Therefore, the embodiments disclosed in the present disclosure are intended to explain, not to limit, the technical scope of the present disclosure, and the technical scope of the present disclosure is not limited by the embodiments. The protection scope of the present disclosure should be interpreted based on the following claims and it should be appreciated that all technical scopes included within a range equivalent thereto are included in the protection scope of the present disclosure.

What is claimed is:

1. An apparatus for displaying a shooting area of a guided missile, comprising a display;

a memory; and a processor configured to display the shooting area of the guided missile on the display and to display an indicator indicating whether the guided missile is able to hit a target on the display based on a size of the shooting area, wherein the processor is configured to display on the display the indicator which has an X-axis position calculated based on a yaw angle between a longitudinal axis line and the target and a horizontal distance from the center of the display to the shooting area, and a Y-axis position calculated based on a pitch direction angle between the longitudinal axis line and the target and a vertical distance from the center of the display to the shooting area, and wherein the indicator indicates that the guided missile is able to hit the target in response to the indicator being displayed within the shooting area.

2. The apparatus of claim 1, wherein the indicator indicates that the guided missile is not able to hit the target by being located outside the shooting area on the display.

3. The apparatus of claim 1, wherein the shooting area is displayed in any size and shape on the display.

4. The apparatus of claim 1, wherein the display is provided in a helicopter, and the shooting area is set by an operator of the helicopter.

5. A method of displaying a shooting area of a guided missile to be performed by an apparatus for displaying a shooting area of a guided missile, the method comprising:

displaying the shooting area of the guided missile on a display;

displaying on the display an indicator indicating whether the guided missile is able to hit a target on the display based on a size of the shooting area; and adjusting a position of the indicator on the display, wherein the displaying the indicator comprises:

calculating an X-axis position of the indicator based on a yaw angle between a longitudinal axis line and the target and a horizontal distance from the center of the display to the shooting area; and calculating a Y-axis position of the indicator based on a pitch direction angle between the longitudinal axis line and the target and a vertical distance from the center of the display to the shooting area, wherein the indicator indicates that the guided missile is able to hit the target in response to the indicator being displayed within the shooting area.

6. The method of claim 5, wherein the indicator indicates that the guided missile is not able to hit the target by being located outside the shooting area on the display.

7. The method of claim 5, wherein the shooting area is displayed in any size and shape on the display.

8. The method of claim 5, wherein the display is provided in a helicopter, and the shooting area is set by an operator of the helicopter.

9. A non-transitory computer-readable storage medium storing instructions, when executed by a processor, configured to perform a method of displaying whether or not shooting is possible, the method comprising:

displaying a shooting area of a guided missile on a display;

displaying on the display an indicator indicating whether the guided missile is able to hit a target on the display based on a size of the shooting area such that the indicator has an X-axis position calculated based on a yaw angle between a longitudinal axis line and the target and a horizontal distance from the center of the display to the shooting area, and a Y-axis position calculated based on a pitch direction angle between the longitudinal axis line and the target and a vertical distance from the center of the display to the shooting area; and adjusting a position of the indicator on the display, wherein the indicator indicates that the guided missile is able to hit the target in response to the indicator being displayed within the shooting area.

10. The non-transitory computer-readable storage medium of claim 9, wherein the indicator indicates that the guided missile is not able to hit the target by being located outside the shooting area on the display.

11. The non-transitory computer-readable storage medium of claim 9, wherein the shooting area is displayed in any size and shape on the display.

12. The non-transitory computer-readable storage medium of claim 9, wherein the display is provided in a helicopter, and the shooting area is set by an operator of the helicopter.

* * * * *